US006213028B1

(12) United States Patent
Fetterman et al.

(10) Patent No.: US 6,213,028 B1
(45) Date of Patent: Apr. 10, 2001

(54) INCREASED CAPACITY RAILWAY CAR

(75) Inventors: Donald B. Fetterman, Arlington; Stephen W. Smith, Dallas, both of TX (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 09/215,445

(22) Filed: Dec. 17, 1998

Related U.S. Application Data

(60) Provisional application No. 60/068,131, filed on Dec. 18, 1997.

(51) Int. Cl.[7] ..... B61D 7/02

(52) U.S. Cl. ..... 105/247; 105/238.1; 105/248; 105/355; 105/404; 105/409

(58) Field of Search ..... 105/1.1, 1.3, 238.1, 105/239, 247, 248, 355, 358, 359, 360, 404, 409

(56) References Cited

U.S. PATENT DOCUMENTS 784,817 * 3/1905 Trapp ..... 105/360
3,583,331 * 6/1971 Mowatt-Larssen ..... 105/360
3,712,250 * 1/1973 Geyer et al. ..... 105/360
4,867,073 * 9/1989 Dugge ..... 105/358

OTHER PUBLICATIONS

"Plate C, Equipment Diagram for Limited Interchange Service," Standard, S–2028–91, *Association of American Railroads, Mechanical Division, Manual of Standards and Recommended Practices,* Adopted 1963, Revised, 1965, 1966, 1967, 1991, p. C–251, 1991.

"Plate C–1, Maximum Width of Cars with Various Truck Centers," Standard, S–2029–66, *Association of American Railroads, Mechanical Division, Manual of Standards and Recommended Practices,* Adopted, 1963; Revised 1966, p. C–252, 1966.

* cited by examiner

*Primary Examiner*—S. Joseph Morano
*Assistant Examiner*—Frantz F. Jules
(74) *Attorney, Agent, or Firm*—Baker Botts L.L.P.

(57) ABSTRACT

A railway car includes a first end, a second end, and a first side disposed longitudinally between the first end and the second end. The first side includes a concave portion in a generally horizontal plane of the railway car. The concave portion provides a railway car with increased cargo-carrying capacity.

17 Claims, 5 Drawing Sheets

INCREASED CAPACITY RAILWAY CAR

RELATED APPLICATIONS

This application claims the benefit of U.S. Provisional Application Serial No. 60/068,131, filed Dec. 18, 1997.

TECHNICAL FIELD OF THE INVENTION

This invention relates generally to railway cars and more particularly to a railway car with increased capacity.

BACKGROUND OF THE INVENTION

Railway cars are useful for transporting large amounts of cargo. Although in some applications it is desirable to manufacture large railway cars, the Association of American Railroads (AAR) has placed constraints on the size of railway cars for safety purposes. For example, the cross-sectional widths and heights of a railway car is limited by the AAR clearance limitations, which specify a maximum width and a maximum height of a railway car at the center of the railway car and also specify maximum heights and widths at other locations along the length of the railway car. Because of the AAR clearance limitations, designers often increase the cargo-carrying capacity of a railway car by increasing the length of the railway car. Unfortunately, as the length of a railway car increases, the width allowed by the AAR clearance limitations decrease to take into account the travel of a railway car around a curve. While traveling around a curve, a portion of a railway car may extend outside a clearance plane specified by AAR limitations, which is not acceptable. Therefore, stricter width clearance limitation is applied to longer railway cars to avoid a railway car making contact with a structure adjacent the railroad.

Thus, the AAR clearance limitations also generally limit the width-to-length ratio at which a railway car may be constructed and therefore further restrict the cargo-carrying capability of a railway car. The amount of cargo a railway car may carry directly impacts the profitability of a railway carrier and is therefore important. Thus, maximizing the amount of cargo a railway car can carry while staying within AAR clearance limitations is desirable.

SUMMARY OF THE INVENTION

Accordingly, a need has arisen for an improved railway car that provides increased cargo-carrying capability. The present invention provides an improved railway car that addresses shortcomings of prior railway cars and increases cargo-carrying capability.

According to one aspect of the invention, a railway car includes a first end, a second end, and a first side disposed longitudinally between the first end and the second end. The first side includes a concave portion in a generally horizontal plane of the railway car.

According to another aspect of the invention, a method of manufacturing an improved railway car includes providing a first end and a second end and connecting a first side and a second side between the first end and the second end. The first side includes a center disposed approximately equidistant from the first end and the second end. The method also includes positioning a portion of the first side toward the second side such that the first side and the second side are separated by a shorter distance at the center of the first side than at the first end and the second end.

The invention provides several technical advantages. For example, the invention provides a railway car with increased cargo-carrying capacity. In one embodiment of the invention, the cargo-carrying capability is approximately 7% over the cargo-carrying capacity of conventional cars. In the same embodiment, the length of a railway car was over 10 inches larger than a conventional car. Both the increases in cargo-carrying capacity and car length were effected while remaining within AAR clearance limitations. Further, a railway car may be made shorter than conventional railway cars, while having a greater cargo-carrying capacity.

Other technical advantages will be readily apparent to one skilled in the art from the following figures, descriptions, and claims.

BRIEF DESCRIPTION OF THE DRAWINGS

For a more complete understanding of the present invention and the advantages thereof, reference is now made to the following descriptions taken in connection with the accompanying drawings in which.

DETAILED DESCRIPTION OF INVENTION

Embodiments of the present invention and its advantages are best understood by referring to FIGS. 1A through 7 of the drawings, like numerals being used for like and corresponding parts of the various drawings.

Figures 1A, 1B, 1C, 1D:
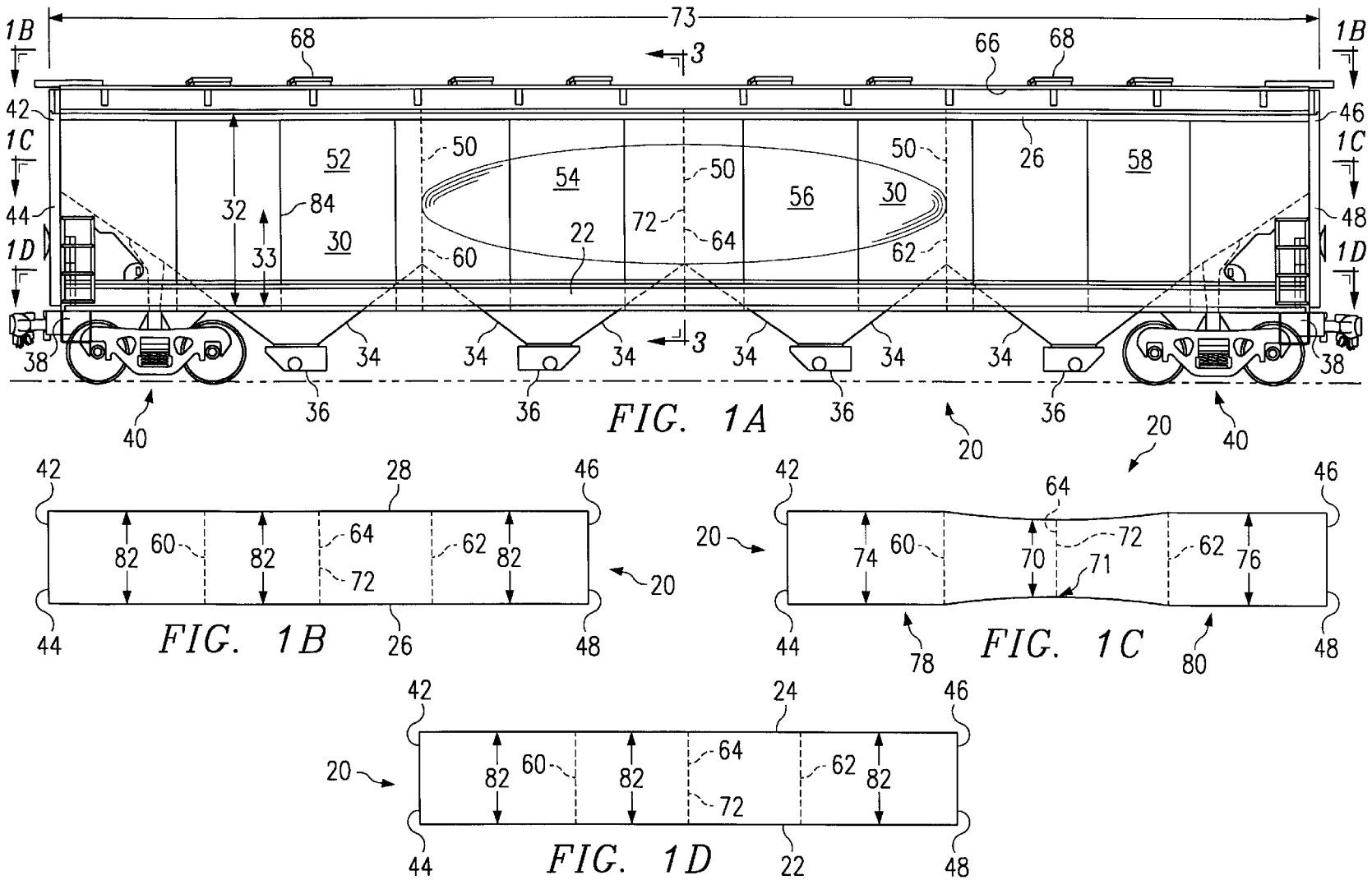
FIG. 1A is a drawing showing an elevational view of a railway car incorporating the teachings of the present invention.
FIG. 1B is a schematic drawing of the railway car illustrated in FIG. 1A, taken along lines 1B—1B of FIG. 1A, showing the exterior configuration of the railway car in the illustrated plane.
FIG. 1C is a schematic drawing of the railway car illustrated in FIG. 1A, taken along lines 1C—1C of FIG. 1A, showing the exterior configuration of the railway car in the illustrated plane.
FIG. 1D is a schematic drawing of the railway car illustrated in FIG. 1A, taken along lines 1D—1D of FIG. 1A, showing the exterior configuration of the railway car in the illustrated plane.
Figure 4A:
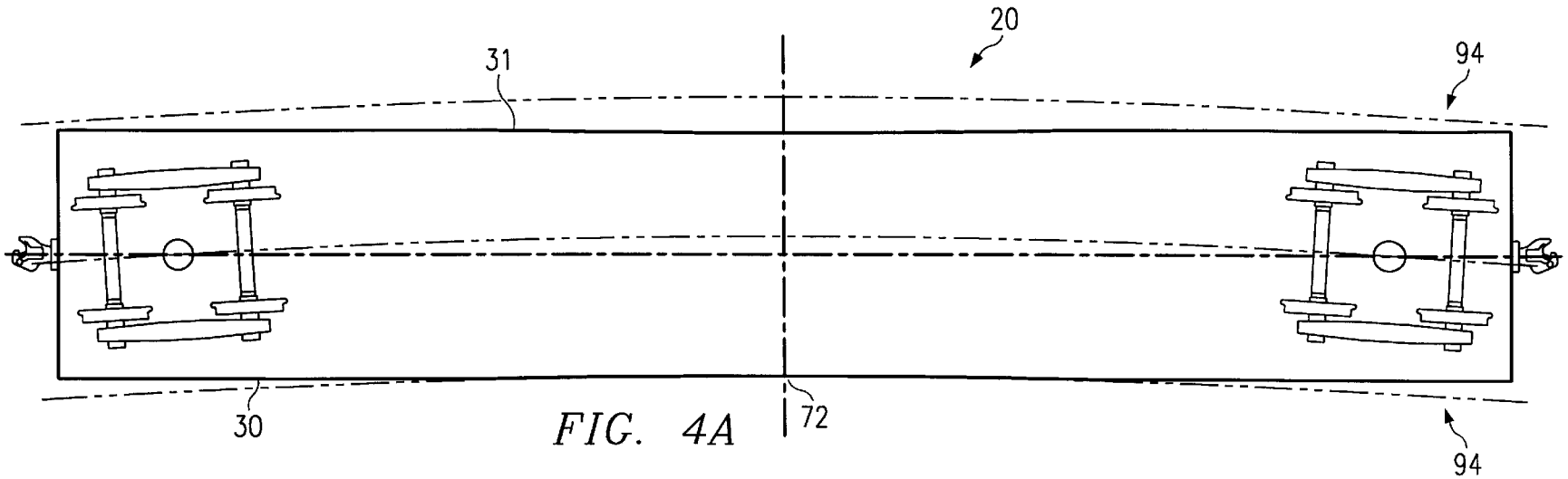
FIG. 4A is a schematic drawing of the railway car illustrated in FIGS. 1A through 2 taken along lines 1C—1C of FIG. 1 showing the exterior shape of the railway car in the illustrated plane and also showing the relationship between the exterior configuration and the required curve clearance profile.

FIG. 1A illustrates an elevational view of a railway car 20 incorporating the teachings of the present invention. Railway car 20 includes a pair of side sills 22 and 24 extending along the length of railway car 20 near the bottom of railway car 20. Side sill 24 is best illustrated in FIG. 1D. Railway car 20 also includes a pair of side plates 26 and 28 running along the length of railway car 20 near the top of railway car 20. Side plate 28 is best illustrated in FIG. 1B. A first side sheet 30 extends between side sill 22 and side plate 26 to retain cargo within railway car 20. Side sheet 30 may include a plurality of individual sheets of material or may be formed from a single piece of material. Railway car 20 has a height 32 between side sill 22 and side plate 26 and between side sill 24 and side plate 28. Railway car 20 also has an approximate center height 33 approximately half-way between side sill 22 and side plate 26 and between side sill 24 and side plate 28. A second side sheet 31 extends between side sill 24 and side plate 28 to retain cargo within railway car 20. Second side sheet 31 is best illustrated in FIG. 4A.

In the embodiment of the invention illustrated in FIG. 1, railway car 20 is a hopper car; however, other types of railway cars may incorporate the teachings of the present invention. A hopper car is one example of a curve-sided railway car. In a curve-sided railway car, a side sheet, such as first side sheet 30, has a generally convex curvature between a bottom support, such as side sill 22, and a top support, such as side plate 26. In the embodiment illustrated in FIG. 1, railway car 20 includes a plurality of hoppers 34. Hoppers 34 include outlet discharge gates 36 for dumping cargo. Cargo carried within hoppers 34 generates a weight load. This load from the cargo is transferred from hoppers 34 to side sills 22 and 24 and to the sides of car. Side sills 22 and 24 transfer this load to a pair of draft sills 38 through bolsters (not explicitly shown). Draft sills 38 are supported by a set of trucks 40. In this manner railway car 20 may carry cargo.

Figure 2:
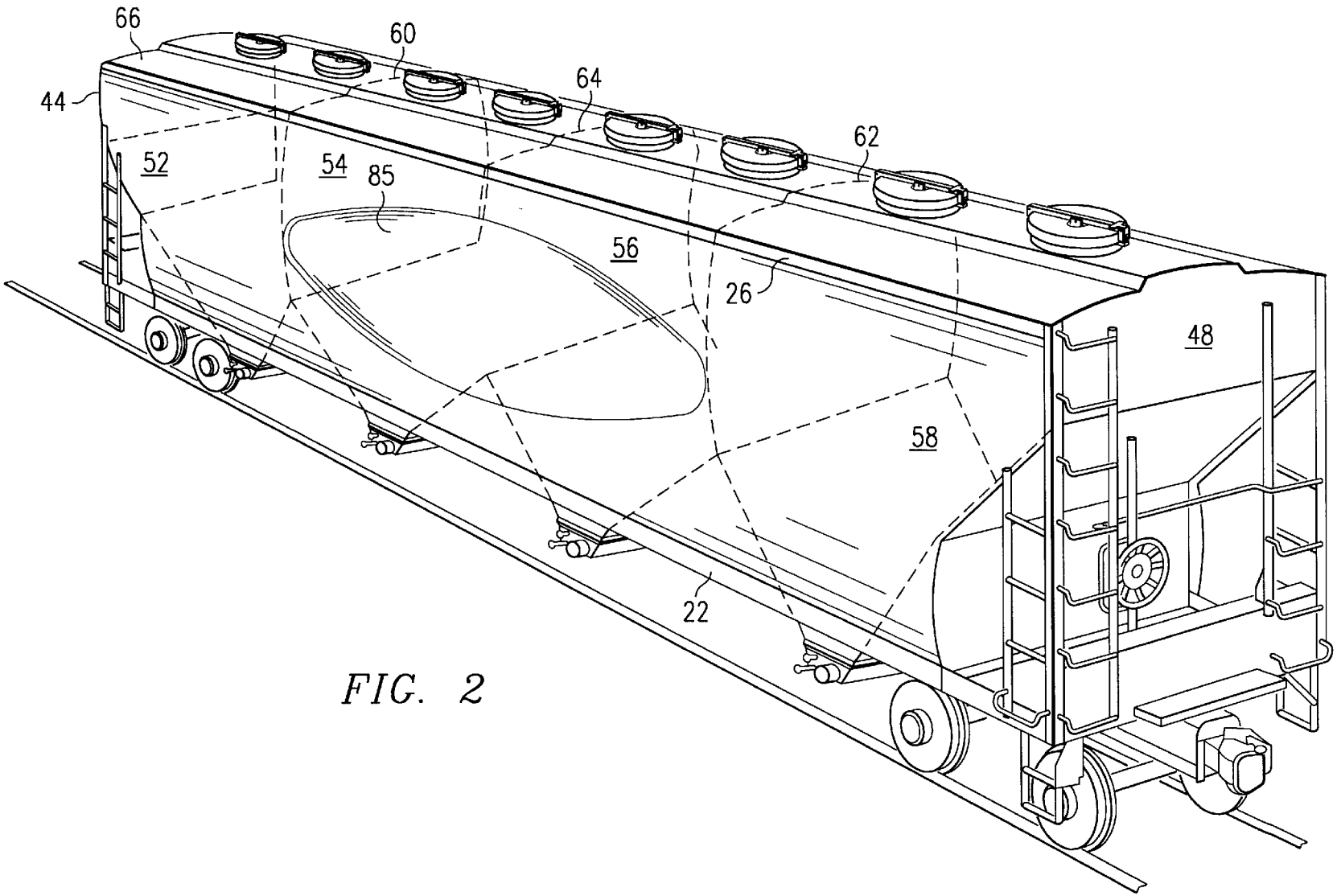
FIG. 2 is a drawing showing a perspective view with portions broken away of the railway car illustrated in FIGS. 1A through 1D, showing the plurality of partitions dividing the railway car into cargo areas and showing a concave portion in a side of the railway car.
Figure 3:
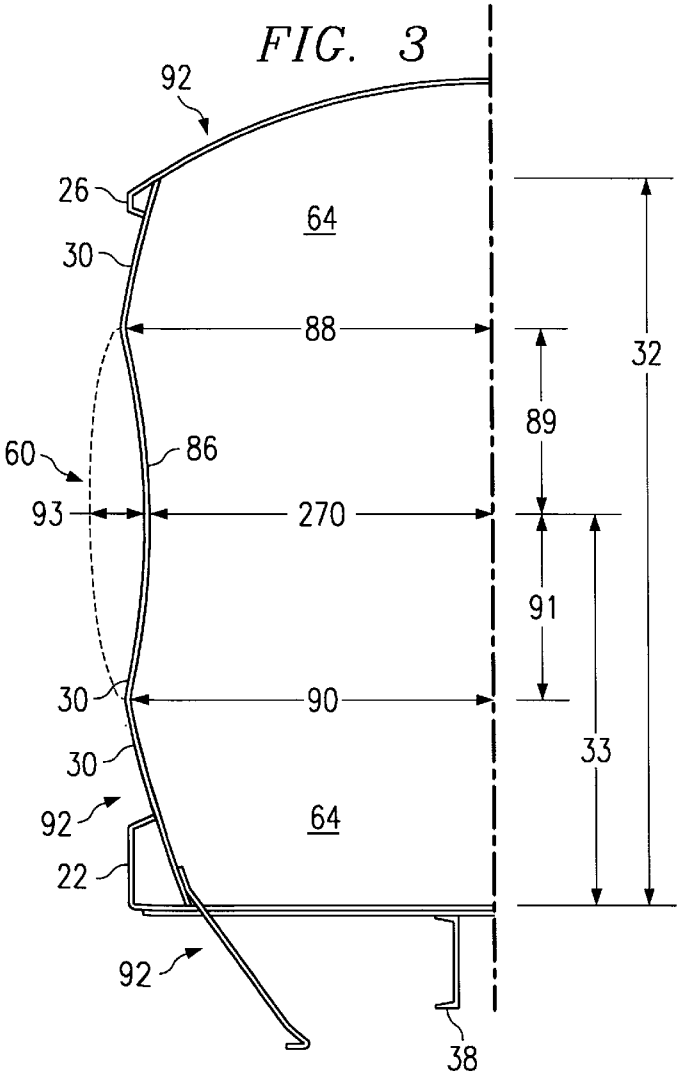
FIG. 3 is a cross-sectional drawing of the railway car in FIGS. 1A through 2 showing a partial view of one of the partitions illustrated in FIGS. 1A through 2 taken along lines 3—3 of FIG. 1.

Railway car 20 includes a first end sheet 42 at a first end 44 of the railway car and a second end sheet 46 at a second end 48 of the railway car. A plurality of partitions 50 are disposed within railway car 20 to divide railway car 20 into a plurality of cargo areas 52, 54, 56, and 58. Cargo areas 52, 54, 56, and 58 are best illustrated in FIG. 2. The plurality of partitions 50 include end partitions 60 and 62 and a center partition 64. Partitions 60, 62, and 64 are best illustrated in FIG. 2. Center partition 64 is positioned approximately half-way between first end 44 and second end 48 at center 72 of railway car 20. Railway car 20 has a length 73 between first end 44 and second end 48. Side sheet 30 is connected to partitions 50 to form a curved side sheet for railway car 20. The curved nature of side sheet 30 is best illustrated in FIGS. 2 and 3. Railway car 20 may also include a roof 66 and a plurality of loading hatches 68 for loading cargo through roof 66.

According to the teachings of the invention, center partition 64 is formed with a different cross-section than end partitions 60 and 62 such that side sheet 30 provides increased cargo carrying capability without exceeding AAR clearance limitations. The providing of increased cargo-carrying capability may be better understood, in part, with reference to FIGS. 1B through 1D.

FIG. 1C is a schematic drawing of railway car 20, illustrated in FIG. 1A, taken along lines 1C—1C of FIG. 1A, showing the exterior configuration of the railway car in the illustrated plane. As illustrated in FIG. 1C, the shape of railway car 20 in the illustrated plane has a generally hourglass configuration in which a width 70 of railway car 20 is less at center 72 of railway car 20 than a width 74 and a width 76 at ends 44 and 48 of railway car 20. By providing this generally hourglass shape, the cargo carrying capability of railway car 20 may be increased while meeting AAR clearance line limitations.

Because the clearance limitations for widths of a railway car require a smaller width at center 72 of railway car 20 than at ends 44 or 48, an hourglass configuration is utilized to maximize cargo-carrying space. As shown, railway car 20 has a concave portion 71 that has a minimum width 70 that is less than the minimum width 74 of a section 78 between sheet 42 and end partition 60 and also has a minimum width 70 that is less than minimum width 76 of a section 80 between end partition 62 and end sheet 46. It should be noted, however, that in this embodiment, the illustrated hourglass configuration does not extend the full height 32 of railway car 20. Rather, the configuration of railway car 20 in the planes denoted by lines 1B—1B and 1D—1D of FIG. 1A are more completely illustrated in FIGS. 1B and 1D. These FIGS. 1B and 1D show that, in this embodiment, the configuration of the railway car in the illustrated planes are rectangular. Cross-sections of railway car 20 between FIGS. 1B and 1C and between FIGS. 1C and 1D vary gradually from generally rectangular to hourglass and back to generally rectangular.

FIG. 1B is a schematic drawing of railway car 20 illustrated in FIG. 1A, taken along lines 1B—1B of FIG. 1A, showing the exterior configuration of railway car 20 in the illustrated plane. FIG. 1D is a schematic drawing of railway car 20 illustrated in FIG. 1A, taken along lines 1D—D of FIG. 1A, showing the exterior configuration of the railway car in the illustrated plane. As illustrated in FIG. 1B, railway car 20 has a relatively constant width 82 between side plates 26 and 28. In addition, as illustrated in FIG. 1D, railway car 20 has a relatively constant width 82 between side sills 22 and 24. As better illustrated in FIGS. 2 and 3, railway car 20 includes portions having hourglass cross sections in planes generally parallel to the plane formed by side sills 22 and 24, which is generally horizontal. Railway car 20 may also have an hourglass configuration in planes generally parallel to the plurality of partitions 50, which are generally vertical.

These hourglass cross sections allow for increased cargo-carrying capacity for railway car 20 while remaining within AAR clearance limitations. The increased cargo-carrying capability arises from the ability to provide a larger railway car 20 having length 73 that is longer than conventional railway cars. Railway car 20 may be longer than conventional railway cars because width 70 at the center of railway car 20 is reduced to meet AAR limitations. If width 70 were increased, AAR limitations would require a shorter length, which would reduce cargo or carrying capability. Furthermore, because sections 78 and 80 are not concaved inward, the width, and therefore cargo-carrying volume, of these sections are maximized. According to one embodiment, cargo-carrying capacity is increased approximately 7% over conventional cars and the length is approximately 10 inches greater than conventional cars. Although a variety of suitable dimensions may be incorporated, in one embodiment, length 73 is approximately sixty-five feet and four inches, width 70 is approximately 9.865 feet and width 82 is approximately ten feet, six and one-half inches. In the same embodiment, the distance between end partition 60 and center partition 62 is 13.5 feet and the distance between center partition 62 and end partition 64 is 13.5 feet.

In addition to providing increased cargo-carrying capacity due to the ability to provide a larger railway car having length 73 that is longer than conventional railway cars while remaining with AAR clearance limitations, other advantages are provided. For example, for a given required cargo capacity, a car may be constructed according to the teachings of the invention to have a length 73 shorter than a conventional length associated with that cargo capacity. A shorter car is generally more maneuverable and lighter than longer cars, and therefore, the ability to provide the same cargo-carrying capability with a shorter car is also advantageous. A shorter car may be constructed while maintaining the same cargo-carrying capacity because the teachings of the present invention allow the width required to provide such capacity to fall within AAR limitations.

FIG. 2 is a perspective view with portions broken away of railway car 20 illustrated in FIGS. 1A through 1D, showing partitions 60, 62, and 64 dividing railway car 20 into cargo areas 52, 54, 56, and 58. As illustrated, side sheet 30 bows inward to reduce the pertinent width of railway car 20 at both approximate center 33 of height 32 of railway car 20 and also at the approximate center 72 of the length 73 of railway car 20. This inward bowing produces concave indention 85. This is accomplished by providing center partition 64 and end partitions 60 and 62 having appropriate cross sections and connecting side sheet 30 to center partition 64 and end partitions 60 and 62. Side sheet 30 may be connected to center partition 64 and end partitions 60 and 62 through a plurality of conventional techniques, including welding. Support members may be provided to provide structural support for concave indentation 85. These members are described in greater detail in conjunction with FIGS. 6A, 6B and 7. As illustrated in FIG. 2, in one embodiment, side sheet 30 begins to bow inward at end partitions 60 and 62. Side sheet 30 is also connected to side plate 26 and side sill 22. Railway car 20 also includes a similar side sheet 31 connected to side sill 24 and side plate 28.

FIG. 3 is an end view of center partition 64 illustrated in FIGS. 1A and 2 taken along lines 3—3 of FIG. 1A. As illustrated, center partition 64 is also bowed inward near center height 33 of center partition 64 and includes a concave portion 86. In one embodiment, concave portion 86 has a maximum bow at a height of 9 feet and 3 inches from the railroad tracks in a car having a total height of 15 feet, 6 inches from the railroad tracks. Because center partition 64 includes concave portion 86, center partition 64 has two maximum widths. A width 88 and a width 90 each represent one-half of these two maximum widths. Widths 88 and 90 are 5 feet and 13/16 inches in the illustrated embodiment; however, other suitable widths may be used. Width 270, illustrated in FIG. 3, is one-half of width 70, illustrated in FIG. 1. In one embodiment, concave portion 86 is formed according to a fifteen foot curve, and distances 89 and 91 are both 2 feet 2⅜ inches. Other embodiments of the present invention include center partition having more than two maximum widths. By bowing concave portion 86 inward, or providing a flat portion 186, the present invention meets the AAR limitations while providing increased cargo-carrying capacity. End partition 60, also shown in FIG. 3, illustrates the differences between the shapes and widths of end partition 60 and center partition 64. According to one embodiment, distance 93 is 4 1/16 inches. Because side sheet 30 is connected to both end partition 60 and center partition 64, side sheet 30 slopes from end partition 62 to center partition 64, as best illustrated in FIG. 1C, and maintains an allowable width for railway car 20 throughout the region of railway car 20 between end partition 60 and center partition 64. Thus concave indentation 85 is concave in both a generally horizontal plane and a generally vertical plane. The portion of railway car 20 between end partition 62 and center partition 64 is similarly constructed. Side sheet 30 maintains a conventional convex curvature 92 throughout the remainder of its connection to center portion 64.

Figure 4B:
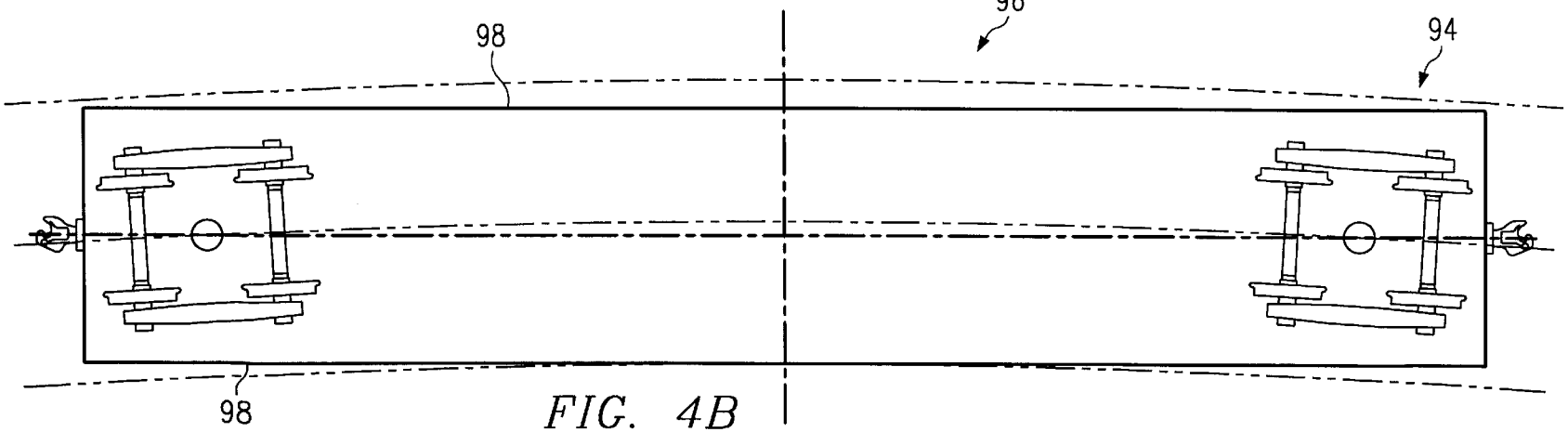
FIG. 4B is a schematic drawing of a conventional railway car taken in a plane analogous to the plane illustrated in FIG. 4A, showing the relationship between the exterior configuration of a conventional railway car in the illustrated plane and the required curve clearance profile.

FIG. 4A is a schematic drawing of railway car 20 taken along lines 1C—1C of FIG. 1 showing a relationship between the exterior configuration of railway car 20 in the illustrated plane and the required curve clearance profile 94. FIG. 4B is a schematic drawing of a conventional railway car 96 taken in a plane analogous to the plane illustrated in FIG. 4A. As illustrated, side sheet 30 bows inward toward the interior of railway car 20 in the illustrated plane. It should be noted, however, that because side plates 22 and 24 and side sills 26 and 28 are not necessarily curved inward in one embodiment, side sheet 30 is only curved inward at elevations of railway car within concave portion 86, shown in FIG. 3. In one embodiment, the curvature of side sheet 30 in concave portion 86 closely approximates the maximum allowable curvature of curved clearance profile 94, which is currently a 13 degree curve. Curved clearance profile 94 illustrates the maximum allowable curvature.

In contrast, a conventional railway car 96 is illustrated in FIG. 4B showing linear side sheets 98. Because linear side sheet 98 is used for conventional car 96, conventional car 96 must have a shorter length than railway car 20 to remain within AAR limits. Therefore, conventional car 96 has less cargo-carry capacity than railway car 20.

Figure 5:
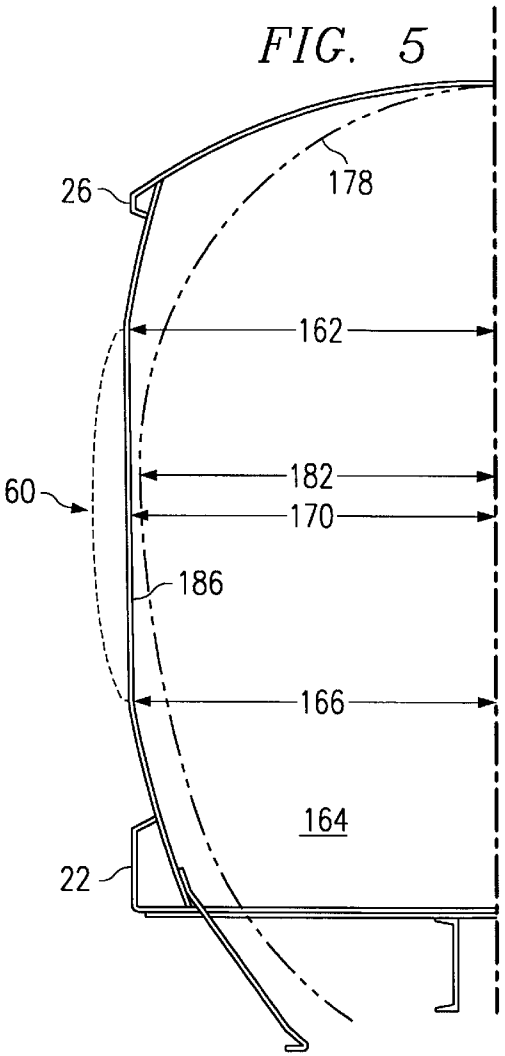
FIG. 5 is a cross-sectional drawing of the railway car in FIGS. 1A through 2 showing a partial view of an alternative embodiment for one of the partitions illustrated in FIGS. 1 and 2 taken along lines 3—3 of FIG. 1.

FIG. 5 is a partial view of an alternative embodiment of center partition 164 of the railway car illustrated in FIGS. 1A through 4A. An alternative embodiment for railway car 20 includes a center partition 164 that includes a straight portion 186 rather than a concave portion 86. As illustrated, the use of straight portion 186 provides a plurality of maximum widths 162, 182, and 166. In contrast, a conventional partition 178 having a single maximum width of 170 is illustrated by a dashed line. End partition 60 is also illustrated in FIG. 5.

Figure 6B:
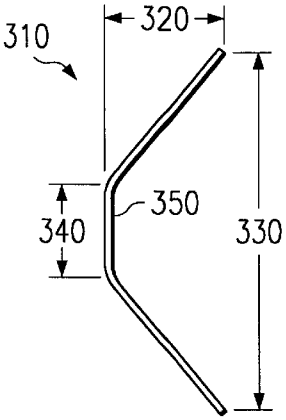
FIGS. 6A and 6B are schematic drawings showing a side view and an end view, respectively, of a side sheet reinforcement member for use in the railway car of FIG. 1.
Figure 6A:
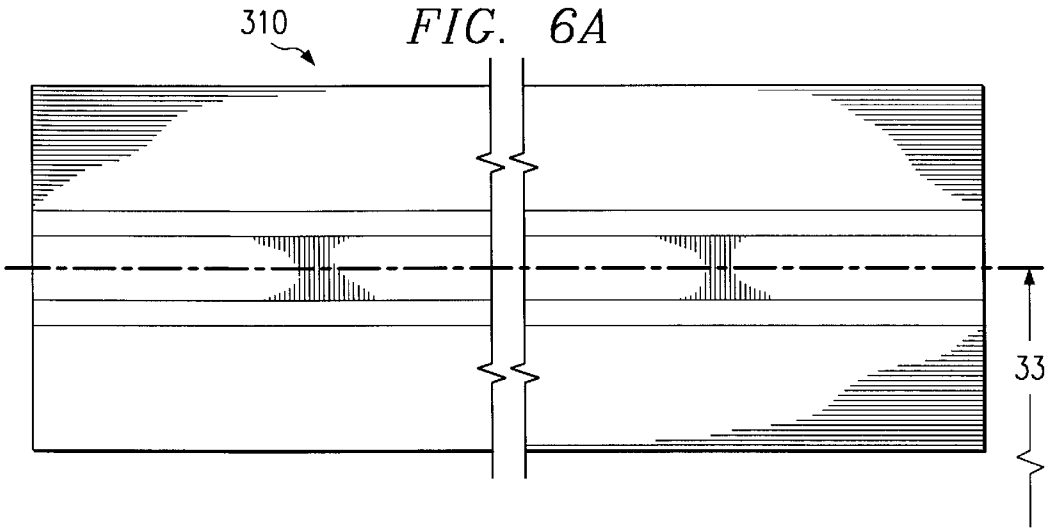

FIGS. 6A and 6B are schematic diagrams showing a side view of an end view, respectively, of a side sheet reinforcement member 310 for use in one embodiment of the invention. Side sheet reinforcement member 310 provides structured support for concave indention 85. In this embodiment, side sheet reinforcement member 310 may be located about the approximate center 33 of railway car 20 and positioned horizontally to extend over a suitable portion of the length 73 of railway car 20. For example, side sheet reinforcement member 310 may extend between partition 60 and partition 62, illustrated best in FIGS. 1B–1D, at a height centered about approximate center 33. In the present embodiment, side sheet reinforcement member 310 is approximately 26 feet and 8.25 inches in length. In this embodiment, side sheet reinforcement member 310 has a depth 320 of four and one-quarter inches and a height 330 of one foot and one and three-quarter inches; however, reinforcement members having other suitable dimensions may also be incorporated. Side sheet reinforcement member also has a straight portion 350 having a height 340 of approximately three and one-half inches.

Side sheets 30 and 31 may be formed with concave indentation 85 according to a variety of techniques. According to one embodiment, concave indentation 85 may be formed by pressing side sheet 30 and 31 into contact with portions 60, 62, and 64 during erection of railway car 20. Side sheets 30 can be creased or pressed to accentuate and maintain the indented shape prior to application. As one alternative, concave indention 85 may be pressed into side sheet 30 before erection of railway car 20. A stiffener may be used to hold the shape of concave indentation 85. Side sheet reinforcement member 310 is illustrated in FIGS. 6A and 6B, which is a horizontal stiffener. Other suitable stiffeners may be used, including vertical stiffeners.

Figure 7:
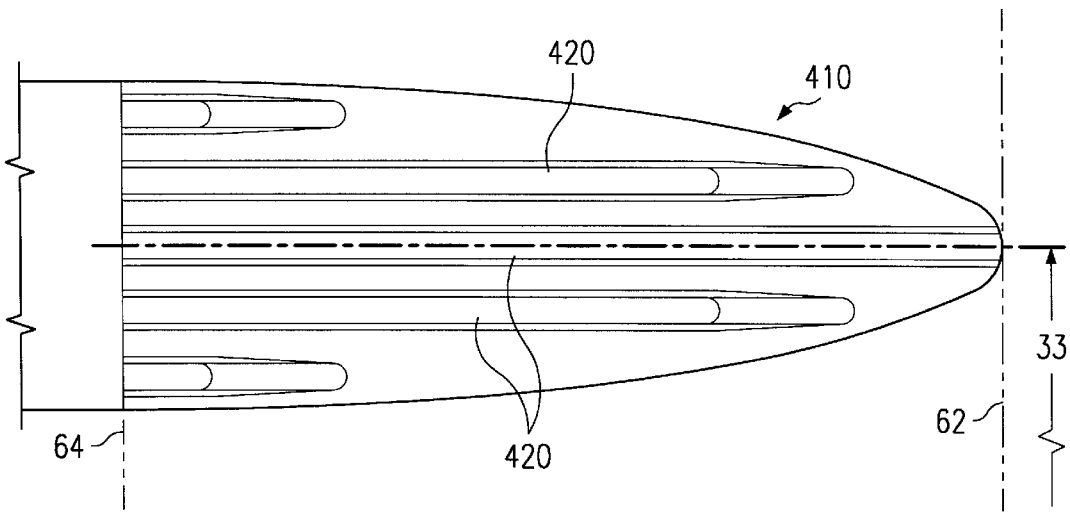
FIG. 7 is a schematic drawing illustrating a plate for use in the railway car of FIG. 1.

FIG. 7 is a schematic drawing illustrating a plate 410, which, in one embodiment, may be used to support concave indention 85. Plate 410 may be stiffened by pressed ribbing, as denoted by arrows 420. According to one embodiment, plate 410 is formed longitudinally between partitions 60 and 62 (FIGS. 1B–1D), is centered about approximate center 33, and is configured to encompass concave indention 85 (FIG. 2). Therefore, plate 410 may be used to provide alternative, or additional, structural support for concave indention 85.

Although the present invention and its advantages have been described in detail, it should be understood that various changes, substitutions, and alterations can be made therein without departing from the spirit and scope of the present invention as defined by the appended claims.

What is claimed is:

1. A railway car comprising:

a first end sheet having a top and a bottom;

a second end sheet having a top and a bottom;

a first side sill and a second side sill disposed between the first end sheet and the second end sheet proximate the bottom of the first end sheet and the bottom of the second end sheet;

a first side plate and a second side plate disposed between the first end sheet and the second end sheet between proximate the top of the first end sheet and the top of the second end sheet;

a first side enclosing the railway car between the first end sheet, the second end sheet, the first side sill, and the first side plate;

a second side enclosing the railway car between the first end sheet, the second end sheet, the second side sill, and the second side plate;

a first end partition connecting the first side and the second side and disposed between the first end sheet and the second end sheet;

a second end partition connecting the first side and the second side and disposed between the first end sheet and the second end sheet;

a center partition connecting the first side and the second side and disposed between the first end partition and the second end partition; and wherein the first side includes a concave portion being concave in a generally horizontal plane and also concave in a generally vertical plane.

2. The railway car of claim 1, wherein the concave portion extends in the generally horizontal plane from approximately the first end partition to the second end partition.

3. The railway car of claim 1, wherein the concave portion has a point closest to the second side that occurs approximately at the center partition.

4. The railway car of claim 2, wherein the second side includes concave portion being concave in a generally horizontal plane and also concave in a generally vertical plane.

5. The railway car of claim 4, wherein the concave portion in the second side extends in the generally horizontal plane from approximately the first end partition to the second end partition.

6. The railway car of claim 5, wherein the concave portion in the second side has a point closest to the first side that occurs approximately at the center partition.

7. A method of manufacturing a railway car, the method comprising:

providing a first end and a second end;

connecting a first side and a second side between the first end and the second end, the first side having a center disposed approximately equidistant from the first end and the second end; and positioning a portion of the first side toward the second side such that the first side and the second side are separated in a generally horizontal plane by a shorter distance at the center of the first side than at the first end and at the second end.

8. The method of claim 7, and further comprising positioning a portion of the second side toward the first side such that the first side and the second side are separated by a shorter distance at the center of the first side than at the first end and at the second end.

9. The method of claim 7, wherein the step of positioning a portion of the first side further comprises forming a concave portion in the first side.

10. The method of claim 9, and further comprising forming a concave portion in the first side.

11. A railway car comprising:

a first end and a second end; and a first side disposed longitudinally between the first end and the second end, the first side having an convex portion surrounding a flat portion.

12. A railway car comprising:

a first end and a second end; and a first side disposed longitudinally between the first end and the second end, wherein a vertical cross section of the first side includes two convex curves joined by a straight line.

13. A railway car comprising:

a first end and a second end;

a first side disposed longitudinally between the first end and the second end, the first side including a concave portion in an outer surface thereof;

a second side disposed longitudinally between the first end and the second end;

a first end partition and a second end partition connecting the first side and the second side; and a center partition connecting the first side and the second side and disposed between the first end partition and the second end partition, wherein the first end partition and the second end partition both have a maximum width in horizontal plane of the railway car that intersects the concave portion, the maximum widths of the first and second end partitions both being greater than the maximum width of the center partition in the horizontal plane.

14. The railway car of claim 13, wherein the center partition includes a concave portion in a generally vertical plane at the railway car.

15. The railway car of claim 13, wherein the center partition has a first maximum width at a first height and a second maximum width at a second height and the center partition has a width at a third height that is less than the first maximum width and is less than the second maximum width, the third height being less than the first height and greater than the second height.

16. A railway car comprising:

a first end and a second end;

a first longitudinal side and a second longitudinal side disposed between the first end and the second end, the first longitudinal side having a concave portion formed therein wherein, on a generally horizontal plane intersecting the concave portion, the first and second sides are separated by a shorter distance than at the first end and at the second end; and a top support and a bottom support connected by the first longitudinal side and wherein the first and second longitudinal sides are generally parallel to each other at a generally horizontal plane through the top support and are generally parallel to each other at a generally horizontal plane through the bottom support at the top support and the bottom support.

17. A railway car comprising:

a first end and a second end; and a first longitudinal side and a second longitudinal side disposed between the first end and the second end, the first longitudinal side having a concave portion formed therein wherein, on a generally horizontal plane intersecting the concave portion, the first and second sides are separated by a shorter distance than at the first end and at the second end, wherein the railway car is generally symmetrical in the generally horizontal plane about a line through the center.

* * * * *